US006648698B1

(12) United States Patent
Achtner

(10) Patent No.: US 6,648,698 B1
(45) Date of Patent: Nov. 18, 2003

(54) GROUNDING TAB FOR A WELDING APPARATUS

(75) Inventor: Richard M. Achtner, Neenah, WI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/065,583

(22) Filed: Oct. 31, 2002

(51) Int. Cl.[7] ..... H01R 13/42
(52) U.S. Cl. ..... 439/737; 439/97; 439/907
(58) Field of Search ..... 439/92, 97, 737, 439/907; 361/799, 800; 174/51

(56) References Cited

U.S. PATENT DOCUMENTS 4,993,959 A * 2/1991 Randolph ..... 439/92
6,302,709 B1 * 10/2001 Ross ..... 439/78

* cited by examiner

*Primary Examiner*—Neil Abrams
*Assistant Examiner*—Phuong Dinh
(74) *Attorney, Agent, or Firm*—Ziolkowski Patent Solutions Group, LLC

(57) ABSTRACT

A welding apparatus having a metal enclosure and a pair of plastic end panels affixed to the enclosure to contain therein the various components of the welding apparatus. A conductive grounding tab is affixed in a receptacle formed in each of the plastic panels and the grounding tab has a friction terminal for easy connection to a standard electrical connector of a grounding wire. The grounding tab has a pair of prongs having angled distal ends that forcefully engage the enclosure when the end panels are assembled to the enclosure to provide a good conductive path to ground from the metal enclosure through that ground wire and ultimately to a ground wire of a supply cable. A second grounding connection between the enclosure and the grounding tab is created by a screw that passes through the enclosure and is threaded into a threaded hole in the grounding tab.

18 Claims, 4 Drawing Sheets

GROUNDING TAB FOR A WELDING APPARATUS

BACKGROUND OF INVENTION

The present invention relates generally to a welding apparatus and, more particularly, a welder having a convenient grounding device that facilitates the assembly of the welding apparatus.

Portable welding units transportable to a work site are known. Typical of such known units include a lightweight enclosure consisting of a sheet metal material, such as aluminum or other metal and which metal enclosure has a front panel and a rear panel at the ends of the enclosure to contain the various components of the welder therein and also includes a base that underlies the enclosure. In general, the front and rear panels, as well as the base of such welding apparatus is constructed of a molded plastic material.

With such welders it is important that certain metal components be grounded. Since the enclosure itself for such welding apparatus is constructed of metal, it is necessary that such enclosures be properly grounded to comply with applicable standards in order to protect the user of the apparatus.

With the joining of two structural components, one common method of grounding an enclosure or panel is through the use of a screw that passes through a clearance hole in the component to be grounded. The underside of the head the screw has a paint-cutting ring such that the tightening of the screw removes paint under the screw head and creates a good electrical contact with the component to be grounded. The screw is then threaded into a component that is already grounded and the screw connects the two components both electrically and mechanically. However, as is evident, the use of such a grounding screw is limited to applications where both of the components are metal so that one component is basically grounded through the other.

Another common method of providing a ground to a metal component, such as an enclosure, is to use a machine screw that passes through a clearance hole in the component to be grounded and a nut is secured on the other side of that component. A ring terminal is placed on top of the nut and still another nut is placed on top of the ring terminal. The nut that touches the component to be grounded makes contact therewith and the ring terminal can be attached to a wire that is connected to ground. While effective, the procedure is rather cumbersome and, therefore, is time consuming in the assembly line operations used to assemble equipment such as welding apparatus.

Finally, as a further grounding method, a sheet metal component may be grounded by bending or welding a tab into the sheet metal component and that tab is manufactured in such as way as to accept a friction connector that is, in turn, connected to a wire that leads to a ground connection. Again, the grounding procedure is not particularly simple and can be a time-consuming action in the assembly of welding apparatus.

Therefore, it would be advantageous to have a simple means of grounding a metal structural component such as the enclosure of a welding apparatus, and which can be carried out with a minimum of disruption or time consumption during the assembly line production of such apparatus and which can be utilized where plastic components are a structural part of the apparatus.

SUMMARY OF INVENTION

The present invention is directed to an improved grounding means for a welding apparatus.

In a preferred embodiment, and as will be specifically described herein, the welding apparatus itself is comprised of a metal enclosure that houses the various components that are utilized in providing a variable power supply to carry out the welding process. The enclosure has a pair of end panels, that is, there is a front panel and a rear panel that are affixed to the enclosure to contain those components therein. The front and rear panels are preferable constructed of a molded plastic material.

Each of the panels includes a receptacle that is molded into the panel. The receptacle has a slotted opening formed therein. In accordance with the invention, a grounding tab is affixed within the receptacle and is fitted therein with an interference fit so that the grounding tab is securely affixed to the receptacle. In the preferred embodiment, the grounding tab has a generally flat, planar metal body with lateral edges and each of the lateral edges has a notch formed therein that allows the grounding tab to be forced into the receptacle but which catches and bites into the sides of the slotted opening to basically prevent the removal of the grounding tab from the receptacle after it has been affixed therein.

The grounding tab also has at least one prong, and preferably a pair of prongs, that extend outwardly from the planar body such that the distal ends of the prongs are bent upwardly to make a forceful electrical contact with the internal surface of the metal enclosure when the end panels are affixed to the enclosure. The grounding tab also has a friction terminal extending outwardly therefrom and which is adapted to be connected to an electrical connector having a grounding wire so that a grounding wire can easily and readily be electrically connected to the grounding tab.

In a preferred embodiment there is also a threaded hole formed in the flat, planar body of the grounding tab. As such, when the end panels are affixed to the metal enclosure, a screw can be passed through a hole in the metal enclosure and then screwed into the threaded hole in the grounding tab to make a second electrical contact between the metal enclosure and the grounding tab as well as to assist in the actual affixation of the end panels to the enclosure.

Thus, with the use of the grounding tab of the present invention, the grounding tab creates two good electrical connections between the metal enclosure and the grounding tab and, accordingly, a ground wire can readily be attached to the friction terminal of the grounding tab and that wire can ground the metal enclosure by connecting to a further ground, such as a ground wire of the electrical supply cable.

With the aforementioned grounding tab and receptacle, it can be seen that the assembly of the welding apparatus is simplified. That is, the grounding tab can be pre-assembled to the receptacle and, during the assembly of the welding apparatus, a ground wire can be quickly, and without tools, affixed to the friction terminal by a standard electrical connector on that ground wire. When the end panels are thereafter affixed to the enclosure, there are two good electrical ground connections made between the metal enclosure all the way to the ground wire and the ground wire can thereafter be connected to a circuit board and eventually provide a conductive path to a ground wire of an electrical supply cable.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

Figure 1:
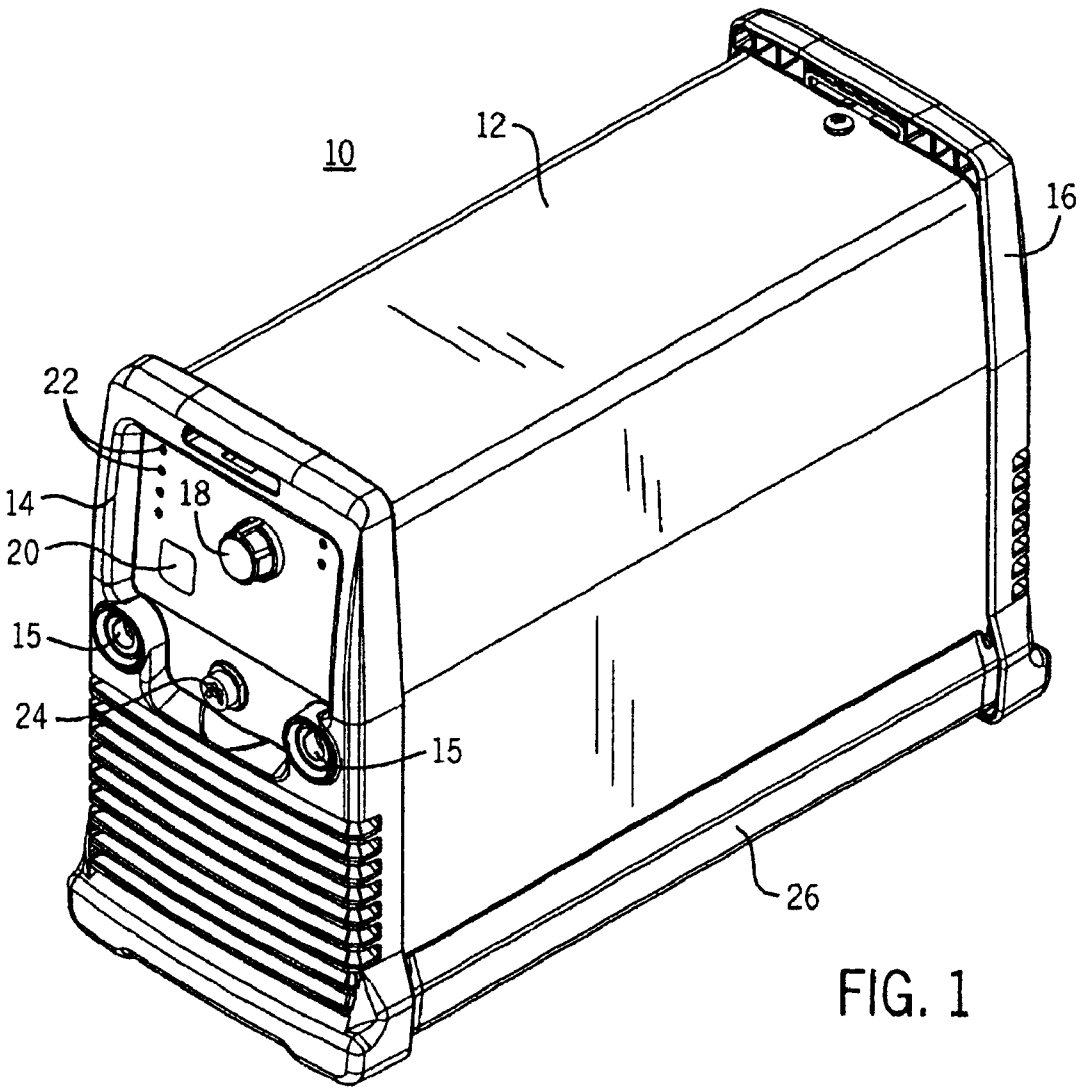
FIG. 1 is a perspective view of a welding apparatus for which the present invention is applicable.

Referring now to FIG. 1, there is shown a welding apparatus 10 that utilizes the present invention. As can be seen, the welding apparatus 10 comprises an enclosure 12 that is a sheet metal construction, preferably of aluminum, and having a front panel 14 and a rear panel 16. Both the front and rear panels 14, 16 are preferably constructed of a molded plastic material. The front panel 14 has a central control section and which includes the various controls for the welding functions and can include female connectors 15 that are used to connect the welding cables.

A control knob 18 is provided in order to control the current to the welding electrodes and a selector button 20 is provided to enable the welding apparatus to be switched between TIG and stick operation. There may also be a series of LED's 22 to provide an indication of status of the welding apparatus and to provide information as to its operation. A remote connector plug 24 is also used for the operation of a remote controls such as a foot operated switch for the welding apparatus 10.

A base 26 is located underneath the enclosure 12 and can also be of molded plastic construction and, as can be seen, the base 26 can be actually elevated with respect to the floor such that the welding apparatus 10 contacts the floor through the front and rear panels 14, 16. It should be noted that the description of the present invention will be in terms of the rear panel 14 to simplify the description, it being understood that the present invention can be, and preferably is, equally applicable to the front panel 14 also.

Figure 2:
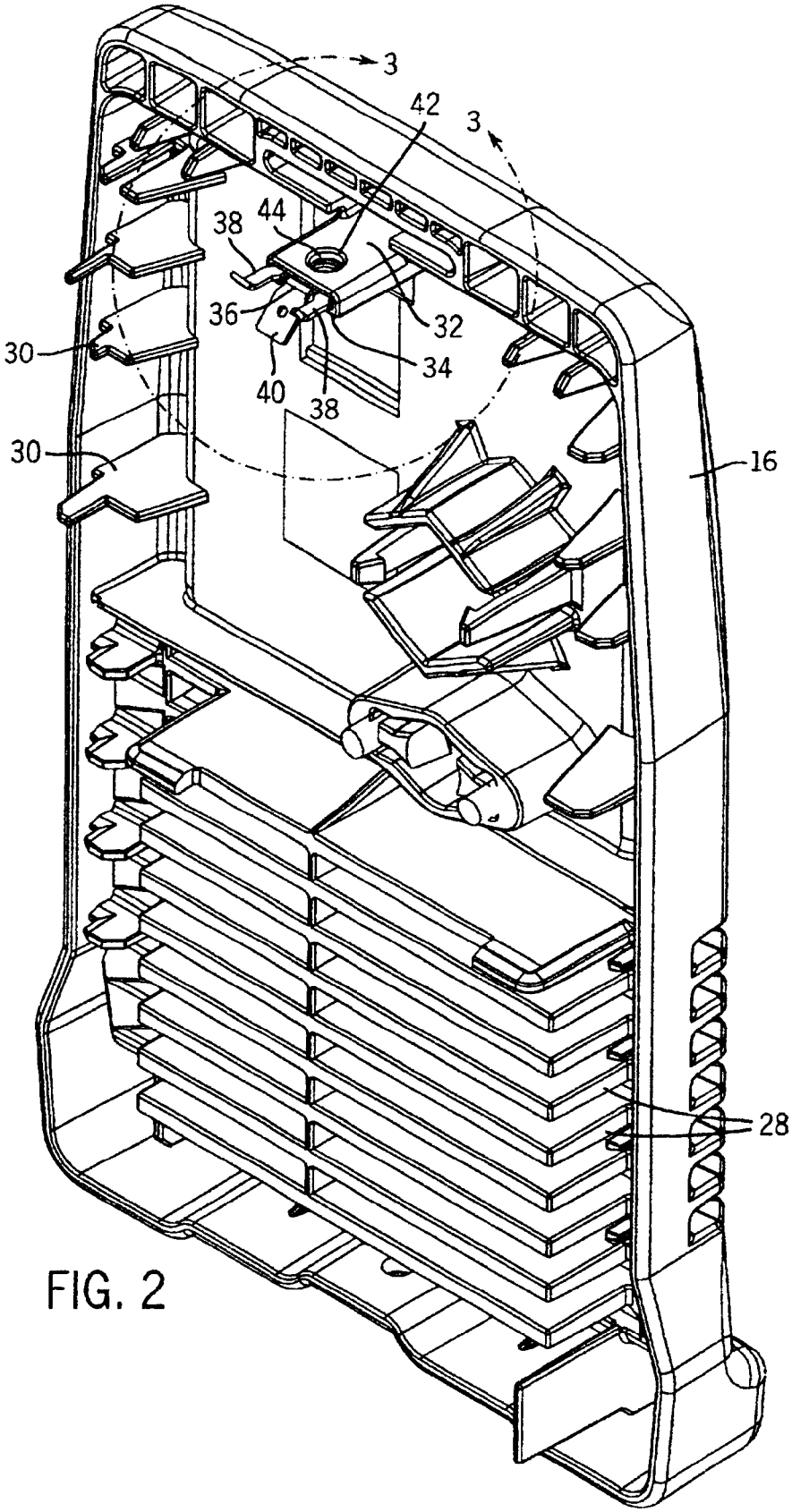
FIG. 2 is a perspective view of a rear panel of the welding apparatus of FIG. 1.
Figure 3:
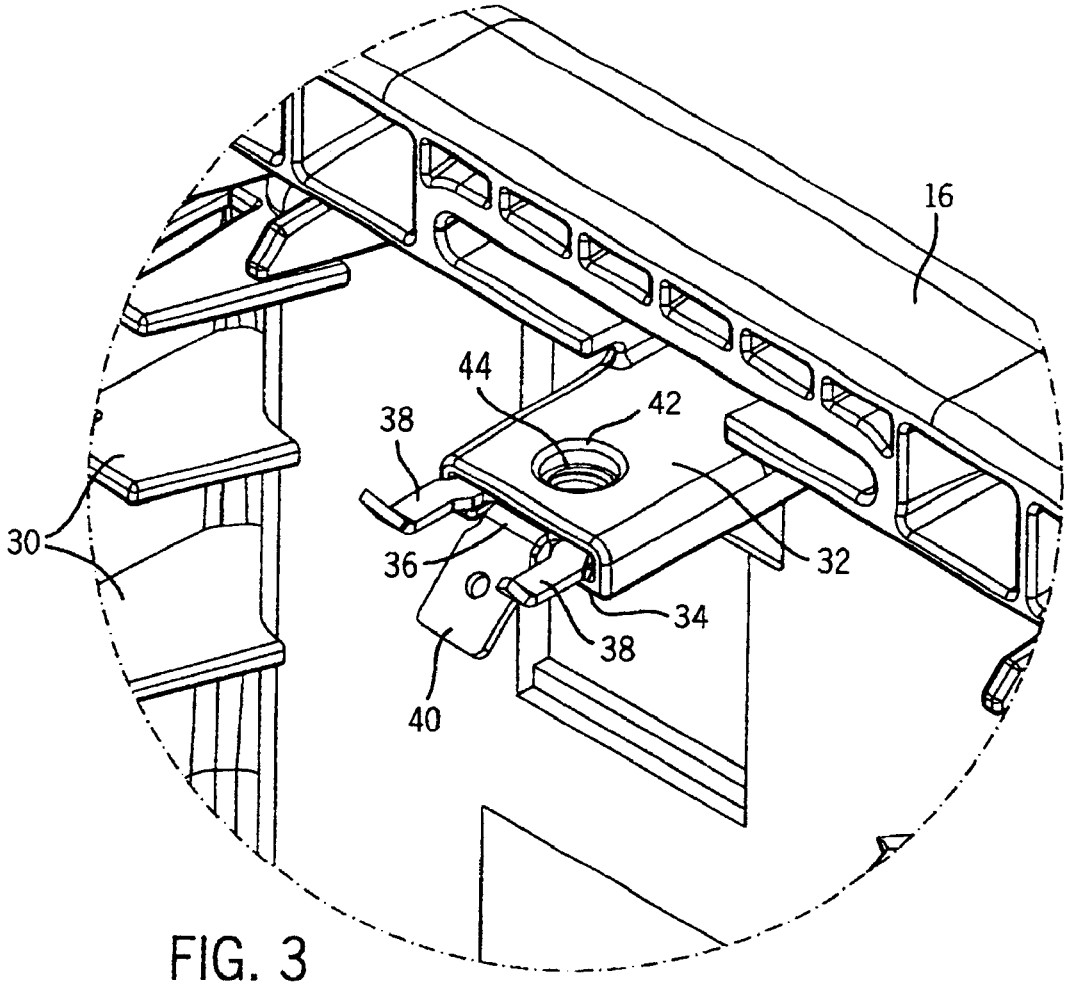
FIG. 3 is an enlarged perspective view of the invention embodied in the rear panel of FIG. 3.

Turning now to FIGS. 2 and 3, taken along with FIG. 1, there are shown perspective views of the rear panel 16 and showing a series of louvers 28 that allow air to circulate through the interior of the enclosure 12 for cooling the inner components of the welding apparatus 10 within the enclosure 12. In addition there are a number of strengthening ribs 30 to assure the integrity of the rear panel 16.

As also can be seen in FIGS. 2 and 3 there is a receptacle 32 that is also molded into the molded plastic construction of the rear panel 14 and which extends outwardly therefrom. The receptacle 32 has a slotted opening 34 formed therein and a grounding tab 36 is affixed within that slotted opening 34.

The grounding tab 36 has a pair of prongs 38 and a downwardly angled friction terminal 40 that is adapted to receive a standard electrical connector that can readily be affixed in an electrical connection to the friction terminal 40 by a frictional engagement, that is, the standard electrical connector is simply fit onto the friction terminal 40 to connect a grounding wire, for example, to the friction terminal 40. As also can be seen, there is an opening 42 in the receptacle 32 and a threaded hole 44 in the grounding tab 36, the purpose of which will be later explained.

Figure 4:
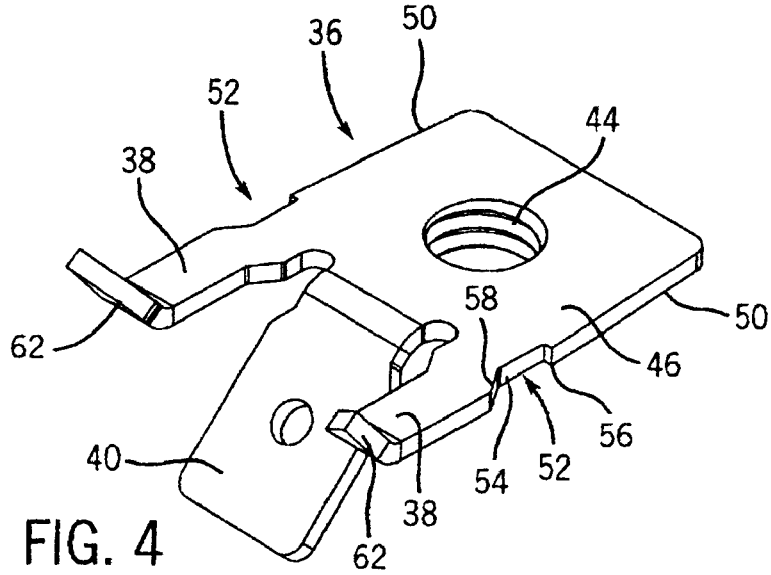
FIG. 4 is a enlarged perspective view of the grounding tab of the present invention.

Turning now to FIG. 4, there is a perspective view of the grounding tab 36 constructed in accordance with the present invention. As seen, the grounding tab 36 comprises a flat, planar body 46 within which there is formed the threaded hole 44. The grounding tab 36 is constructed of a conductive metal material and has two lateral edges 50 with notches 52 formed in both of those lateral edges 50. Each notch 52 has an indented surface 54 and a sharp forward edge 56 that leads from the indented surface 54 to the exterior of the lateral edge edges 50. A rear transition surface 58 forms a sloped, gradual area between the indented surface 54 and the lateral edge 50.

Accordingly, referring to FIG. 4 along with FIG. 3, with the notches 52, the grounding tab 36 can be pressed into the slotted opening 34 in the receptacle 43 in an interference fit and the notches 52 slide fairly readily into the slotted opening 34 but an attempt to remove grounding tab 36 results in the sharp forward edges 56 of the notches 52 biting into the inside surface that forms the slotted opening 34 and creates a substantial resistance to the removal of the grounding tab 36. Thus, the use of the notches 52 substantially prevents the grounding tab 36 from being removed from the receptacle 32 once inserted in the interference fit into that receptacle 32.

Extending from the flat, planar body 46 is a bifurcated area that forms the prongs 38 that extend rearwardly and outwardly with respect to the receptacle 32 when the grounding tab 36 is fitted therein. As can be seen, the distal ends 62 of the prongs 38 are bent upwardly.

As also can be seen, the friction terminal 40 is angled downwardly and the friction terminal 40 is dimensioned to accept a standard electrical connector so that a grounding wire can be readily affixed to the grounding tab 36 by that grounding wire simply affixed onto the friction terminal 40 in a conventional manner.

Figure 5:
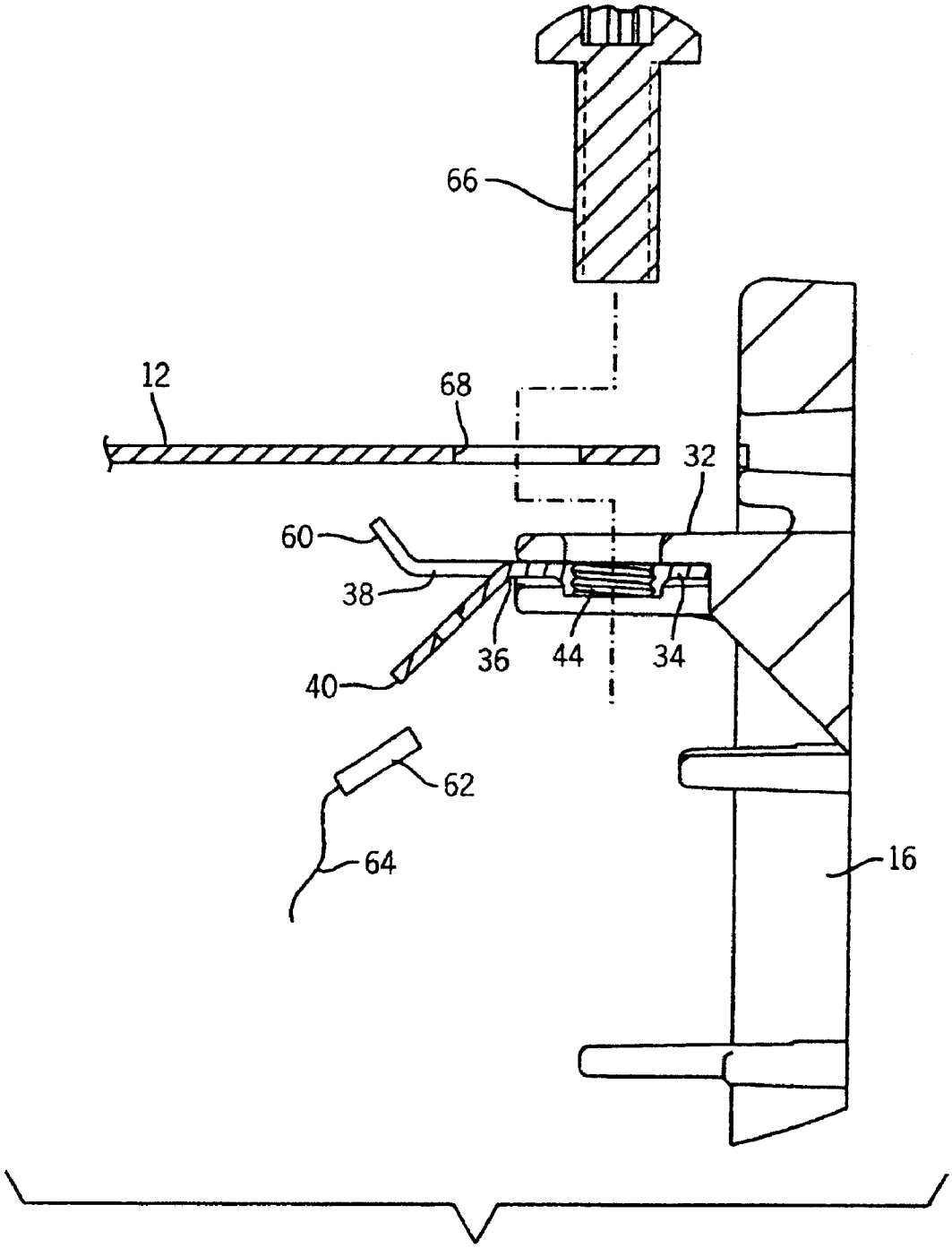
FIG. 5 is an exploded view of the grounding tab of the present invention and showing the affixation of the rear panel to an enclosure of a welding apparatus.

Turning, finally, to FIG. 5, there is shown an exploded view of the grounding tab 36 of the present invention and illustrating its use and assembly. In FIG. 5, it can be seen that the rear panel 16 has the receptacle 32 molded therein and which extends outwardly therefrom. The grounding tab 36 has been interference fitted into the slotted opening 34 formed in the receptacle 32. The metal enclosure 12 is assembled by being placed atop of the receptacle 32 and, as can therefore be seen, that assembled position causes the distal ends 60 of the prongs 38 to forcefully engage the undersurface of the enclosure 12 and thereby make a good electrical, grounding contact between the metal enclosure 12 and the grounding tab 36.

In addition, due to the downward angle of the friction terminal 40, that friction terminal 40 can readily be connected to a standard electrical connector 62 that connects grounding wire 64 to the grounding tab 36. The grounding wire 64 can, of course, then be connected to a ground by conventional means, such as through a circuit board and ultimately to the ground wire of an electrical supply cable used for powering the welding apparatus.

As a further ground connection, there is a screw 66 that passes through an aperture 68 in the enclosure 12 and then is threaded into the threaded hole 44 in the grounding tab 36 that also establishes a second ground connection between the metal enclosure 12 and the grounding tab 36 as well as serve as a means of affixing the rear panel 16 to the enclosure 12.

In the assembly of the welding apparatus 10 (FIG. 1), it can therefore be seen that the assembly is simplified since the grounding tab 36 can be affixed prior to the actual assembly of the welding apparatus 10. That is, prior to the time the rear panel 16 and the front panel 14 are actually affixed to the enclosure 12, the grounding wire 64 can simply be connected to the already present grounding tab 36. This simplifies the assembly and avoids any complex, time consuming tasks to perform to assure that the enclosure 12 is properly grounded during the actual assembly of the welding apparatus 10.

The present invention has been described in terms of the preferred embodiment, and it is recognized that equivalents, alternatives, and modifications, aside from those expressly stated, are possible and within the scope of the appending claims.

What is claimed is:

1. A welding apparatus comprising a metal enclosure and a molded plastic end panel affixed to the metal enclosure, the molded end panel having a receptacle formed therein and having a grounding tab affixed within the receptacle, the grounding tab having a body and having at least one prong extending from the body and contacting the metal enclosure, the grounding tab further having a friction terminal adapted to be connected to a grounding wire.

2. The welding apparatus as defined in claim 1 wherein the grounding tab is interfitted within the receptacle in an interference fit.

3. The welding apparatus as defined in claim 1 wherein the grounding tab has lateral sides and the lateral sides have notches adapted to interfit within the receptacle to essentially prevent the removal of the grounding tab from the receptacle.

4. The welding apparatus as defined in claim 1 wherein the grounding tab has a threaded hole formed therein and the body of the grounding tab has a flat, planar configuration.

5. The welding apparatus as defined in claim 4 wherein the end panel is affixed to said metal enclosure by means of a screw passing through the enclosure and threaded within the threaded hole in the grounding tab.

6. The welding apparatus as defined in claim 4 wherein the friction terminal extends at a downward angle with respect to the flat, planar body.

7. The welding apparatus as defined in claim 1 wherein the at least one prong has a distal end angled upwardly with respect to the grounding tab body.

8. The welding apparatus as defined in claim 7 wherein the at least one prong comprises a pair of prongs.

9. A one piece grounding tab for use in grounding a structure component to be grounded, the grounding tab comprising a generally flat, planar metal body and having at least one prong extending outwardly from the body and adapted to contact a component to he grounded, the grounding tab further having a friction terminal adapted to receive an electrical connector of a grounding wire.

10. The grounding tab of claim 9 wherein the at least one prong comprises two prongs extending outwardly from the body.

11. The grounding tab of claim 10 wherein the two prongs each have distal ends extending at an angle with respect to the flat, planar body.

12. The grounding tab to claim 9 wherein a threaded hole is formed in the flat, planar body of the grounding tab.

13. The grounding tab of claim 9 wherein the flat planar body has lateral edges having notches formed therein.

14. The grounding tab of claim 13 wherein the notches have a sharp edge adapted to bite into a surface sliding along the lateral edges.

15. A method of assembling a welding apparatus, said method comprising the steps of:

providing a enclosure constructed of a metal material, providing a molded plastic end panel to be fined to the enclosure and having a receptacle formed therein, providing a grounding tab comprising a flat body having at least one prong and a friction terminal formed therein, the grounding tab having a threaded hole, affixing the grounding tab to the end panel by force fitting the grounding tab into the receptacle, attaching the end panel to the enclosure by threading a screw into the threaded hole in the grounding tab while positioning the at least one prong to contact the enclosure.

16. The method as defined in claim 15 wherein the step of providing a grounding tab having at least one prong comprises providing grounding tab having a pair of prongs.

17. The method as defined in claim 16 wherein the step of providing a grounding tab having a pair of prongs comprises providing grounding tab having a pair of prongs having distal ends formed at an angle with respect to the flat body.

18. The method as defined in claim 16 wherein the step of attaching the panel comprises passing the screw through the enclosure to make an electrical contact therewith to electrically connect the enclosure with the grounding tab.

* * * * *

UNITED STATES PATENT AND TRADEMARK OFFICE

CERTIFICATE OF CORRECTION

PATENT NO. : 6,648,698 B1
DATED : November 18, 2003
INVENTOR(S) : Richard M. Achtner It is certified that error appears in the above-identified patent and that said Letters Patent is hereby corrected as shown below:

Column 6,
Line 24, delete the word "fined" and substitute therefore -- fitted --.

Signed and Sealed this

Thirtieth Day of December, 2003

JAMES E. ROGAN
*Director of the United States Patent and Trademark Office*